US012599272B2

(12) United States Patent
Dunn et al.

(10) Patent No.: US 12,599,272 B2
(45) Date of Patent: Apr. 14, 2026

(54) MULTI-FUNCTION PAPER TOWEL HOLDER

(71) Applicant: MUNCHKIN, INC., Van Nuys, CA (US)

(72) Inventors: Steven Bryan Dunn, Beverly Hills, CA (US); Kevin Douglas Johnson, Tarzana, CA (US); Britt Ashcraft, Valencia, CA (US); Yanqi Li, Beijing (CN); Yixiang Li, Shanghai (CN)

(73) Assignee: MUNCHKIN, INC., Van Nuys, CA (US)

( * ) Notice: Subject to any disclaimer, the term of this patent is extended or adjusted under 35 U.S.C. 154(b) by 569 days.

(21) Appl. No.: 18/112,372

(22) Filed: Feb. 21, 2023

(65) Prior Publication Data

US 2024/0277190 A1 Aug. 22, 2024

(51) Int. Cl.
*A47K 10/38* (2006.01)

(52) U.S. Cl.
CPC .... *A47K 10/3836* (2013.01); *A47K 2010/389* (2013.01)

(58) Field of Classification Search
CPC ..... A47K 10/3836
See application file for complete search history.

(56) References Cited

U.S. PATENT DOCUMENTS

| | | | | |
|---|---|---|---|---|
| 5,400,982 | A * | 3/1995 | Collins | A47K 10/36 242/564.4 |
| 10,618,070 | B1 * | 4/2020 | Leff | B05B 15/30 |
| 2007/0228065 | A1 * | 10/2007 | Anderson | B65D 83/0409 221/152 |
| 2012/0273515 | A1 * | 11/2012 | Hutchison | A47K 10/42 221/45 |
| 2022/0183509 | A1 * | 6/2022 | Yang | A47K 5/1202 |

* cited by examiner

*Primary Examiner* — Gene O Crawford
*Assistant Examiner* — Ayodeji T Ojofeitimi
(74) *Attorney, Agent, or Firm* — ArentFox Schiff LLP

(57) ABSTRACT

A multi-function paper towel assembly has a frictional component to control paper towel rolling, and a removable spray bottle container that is positioned inverted, and inside the vertical shaft that holds the paper towel. An accompanying funnel may be attachable to the assembly.

20 Claims, 23 Drawing Sheets

MULTI-FUNCTION PAPER TOWEL HOLDER

TECHNICAL FIELD

The subject disclosure relates generally to paper towel holders. More particularly, the present disclosure relates to multi-function paper towel holders.

BACKGROUND

Paper towels have become a ubiquitous product in the home and workplace, not only in the United States, but across the world. It is one of the most commonly found products in virtually any kitchen worldwide.

Paper towels are often used to clean dry or liquid spills, or clean and wipe surfaces. One common way to maintain a paper towel in a specific position is through a paper towel holder. Such holders may be fastened against a wall, such that the paper towel is positioned and dispensed horizontally. The wall mounted paper towel holder is fixed in place and cannot move, so a user would have to go to the mounted paper towel to obtain paper towels. Another more versatile paper towel holder is the portable vertical paper towel stand, which positions and dispenses the paper towel vertically. Since the vertical paper towel stand is usually freestanding and not mounted, it can more easily be transported as needed.

Paper towels are often used in conjunction with water, a spray cleaner, a disinfectant or other associated cleansing product. These cleaning products are oftentimes stored in the vicinity of a paper towel holder. However, use therewith is not convenient when the cleaning product cannot be easily located. In this current climate, where individuals are more sensitive to maintaining clean and disinfected environments, there is a need for a convenient solution to use both the paper towel and the cleaning product.

SUMMARY

The present subject disclosure describes a multi-function paper towel holder with incorporated sprayer. The footprint of the subject disclosure may be the same as any standard vertical paper towel holder. It's novel configuration and design allows for versatility in storing a spray bottle of water or other cleaning fluid with the paper towel roll. Further, an optional funnel may also be included with or within the holder assembly.

In one exemplary embodiment, the present subject disclosure is a paper towel holder assembly. The assembly includes a base having a top surface and a lower surface. A hollow vertical shaft is connected at a bottom end to an aperture in the base; and a removable spray container having a spray hole and a base is provided. The removable spray container is positioned at a top end of the vertical shaft, wherein the spray container is inverted such that its base is accessible and positioned outside of the vertical shaft and its spray hole is positioned inside of the hollow vertical shaft.

In another exemplary embodiment, the present subject disclosure is a paper towel holder assembly. The assembly includes a base having a circular recess portion; a circular disc composed of a friction causing material that fits within the circular recess portion with a top surface of the circular disc extending above a top surface of the base; a hollow vertical shaft connected at a bottom end through the circular disc to an aperture in the base; and a removable spray container having a spray hole and a base, and positioned at a top end of the vertical shaft, wherein the spray container is inverted such that its base is positioned outside of the vertical shaft and its spray hole is positioned inside of the hollow vertical shaft.

In yet another exemplary embodiment, the present subject disclosure is a paper towel holder assembly. The assembly includes a base having a circular recess portion; a circular disc composed of a friction causing material that fits within the circular recess portion with a top surface of the circular disc extending above a top surface of the base; a hollow vertical shaft connected at a bottom end through the circular disc to an aperture in the base; a removable spray container having a cap which is removable from a body portion to access an interior of the body portion, a spray hole and a base, and positioned at a top end of the vertical shaft, wherein the spray container is inverted such that its base is positioned outside of the vertical shaft and its spray hole is positioned inside of the hollow vertical shaft; and a funnel which is attachable to the spray container base.

BRIEF DESCRIPTION OF THE DRAWINGS

Various exemplary embodiments of this disclosure will be described in detail, wherein like reference numerals refer to identical or similar components or steps. The accompanying drawings, which are incorporated in and constitute a part of this specification, illustrate embodiments of the subject disclosure and technical data supporting those embodiments, and together with the written description, serve to explain certain principles of the subject disclosure.

DETAILED DESCRIPTION

The following detailed description references specific embodiments of the subject disclosure and accompanying figures, including the respective best modes for carrying out each embodiment. It shall be understood that these illustrations are by way of example and not by way of limitation.

Particular embodiments of a multi-function paper towel holder assembly will now be described in greater detail with reference to the figures.

Figure 1:
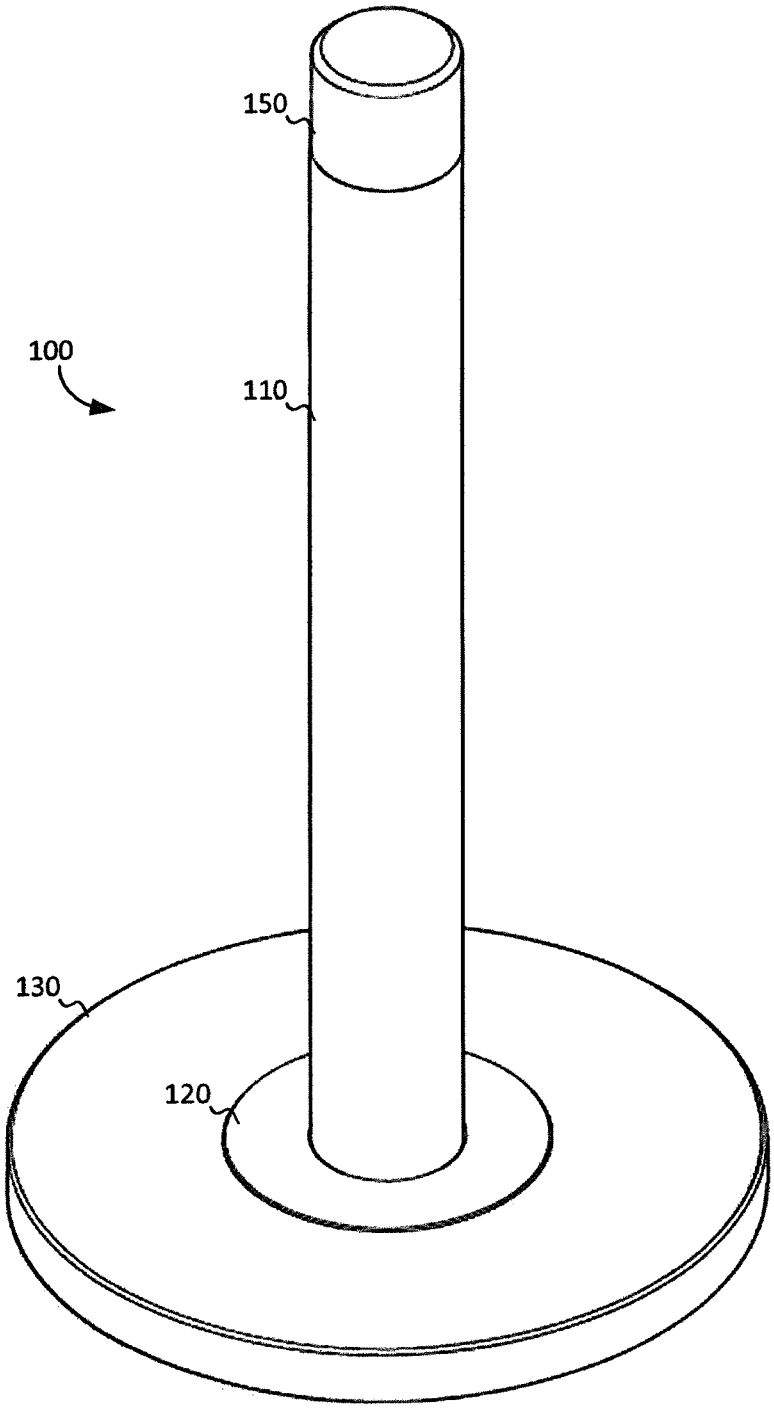
FIG. 1 is a perspective view of a paper towel holder assembly, according to an exemplary embodiment of the present subject disclosure.

FIG. 1 shows a paper towel holder assembly according to an exemplary embodiment of the present subject disclosure. The assembly 100 includes a vertically oriented hollow shaft 110, which may be composed of metal, plastic, hard rubber, wood, or some combination thereof. The vertical shaft 110 is where the paper towel roll will be held by insertion through the center aperture of a standard paper towel roll. At a bottom end of the vertical shaft 110 is a friction element or friction disc 120. The friction disc 120 is composed of a friction producing material, such as rubber, silicone, a textured surface, or some combination thereof, for the purpose of providing a frictional contact to the paper towel that is inserted and resting thereon. When a sheet of paper towel is pulled and ripped from a roll that is positioned on the vertical shaft 100, the weight of the roll is pressed upon the friction disc 120 and base 130. The friction disc 120 has a smaller diameter than that of the base 130, and provides some level of friction to the innermost portion of a paper towel roll. Thus, if the paper towel roll is full, the friction disc 120 provides frictional contact and resistance to the inner portion of the paper towel roll resting thereon, while an outer portion of the paper towel roll is in contact with the base 130. If the paper towel roll is mostly diminished so that its diameter is the same or less than the diameter of the friction disc 120, then the entire remaining roll of paper towel is completely in contact with the friction disc 120. It is to be understood that the configuration for the friction element or friction disc 120 may be any shape of a plurality of shapes surrounding the vertical shaft 110. Portions of the friction element may be disposed anywhere on the assembly 100 to provide resistance to the sheet of paper towel being pulled from the roll according to this subject disclosure. For example, the friction element may be provided on the vertical shaft itself to provide friction resistance to the roll when a piece of paper towel is pulled from the paper towel roll.

Friction disc 120 provides some level of resistance to the bottom edge of the paper towel in contact therewith to minimize the tendency of the paper towel to over roll and over dispense when a single paper towel is desired. Stated differently, friction disc 120 provides friction to the bottom portion of the paper towel to better control against over dispensing of the paper towel when the paper towel is being pulled by a user.

At the top end of the assembly 110 is a sprayer 150, which is positioned within the hollow vertical shaft 110, as will be described in more detail below. The diameter of the outer portion of the sprayer 150 when it is positioned within the vertical shaft 110, may be the same as the diameter of the vertical shaft 110 to allow for a more uniform appearance and allow the sprayer 150 to act as the extension of the vertical shaft 110 when the paper towel inserted therein has a longer axial length.

Figure 2:
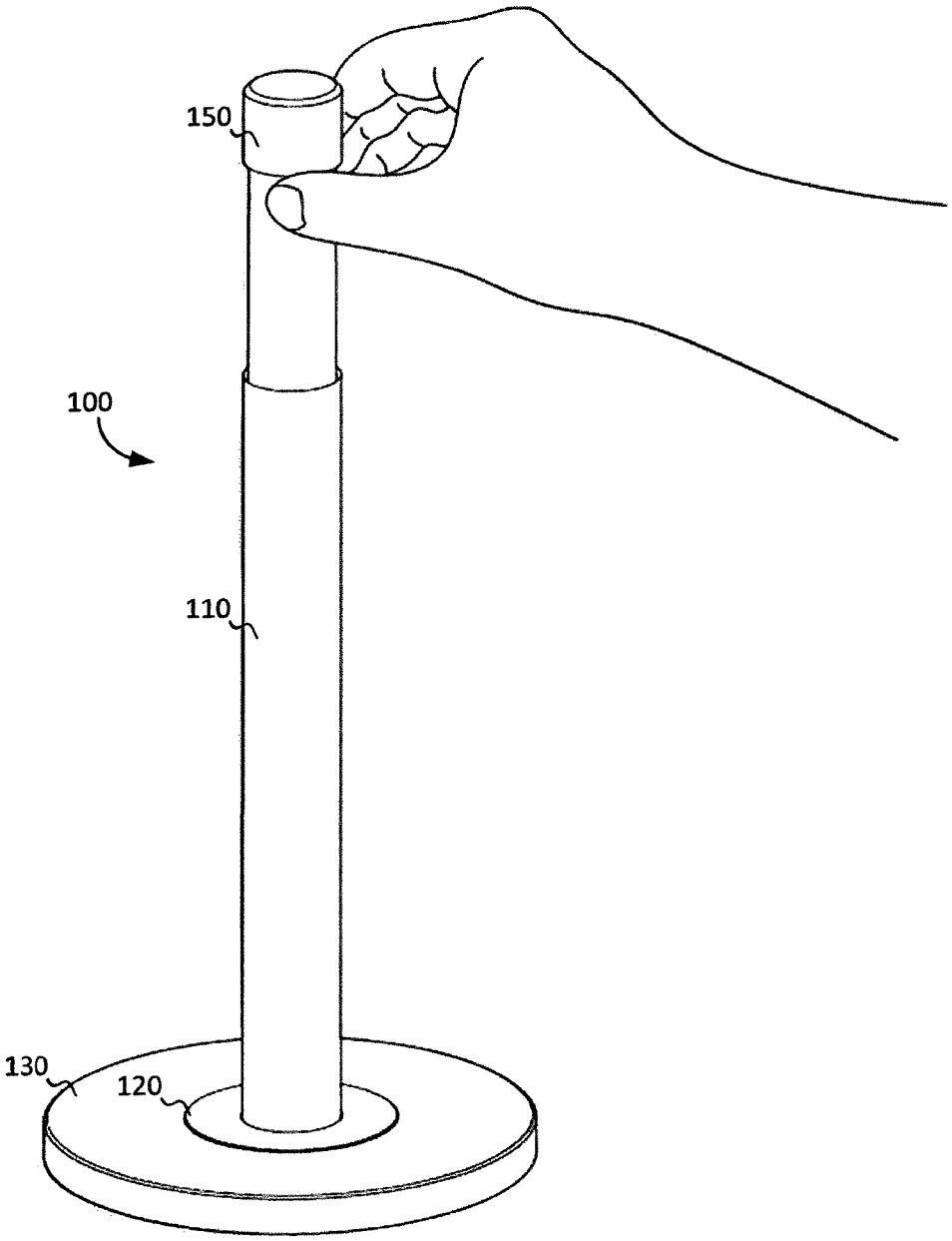
FIG. 2 is a perspective view of a paper towel holder assembly with sprayer partially removed, according to an exemplary embodiment of the present subject disclosure.

As shown in FIG. 2, the sprayer 150 is removable from the vertical shaft 110 of the assembly 100 by gripping and pulling up and away in a direction opposite to the base 130. The vertical pull upward is in the longitudinal axis of the vertical shaft 110.

Figure 3:
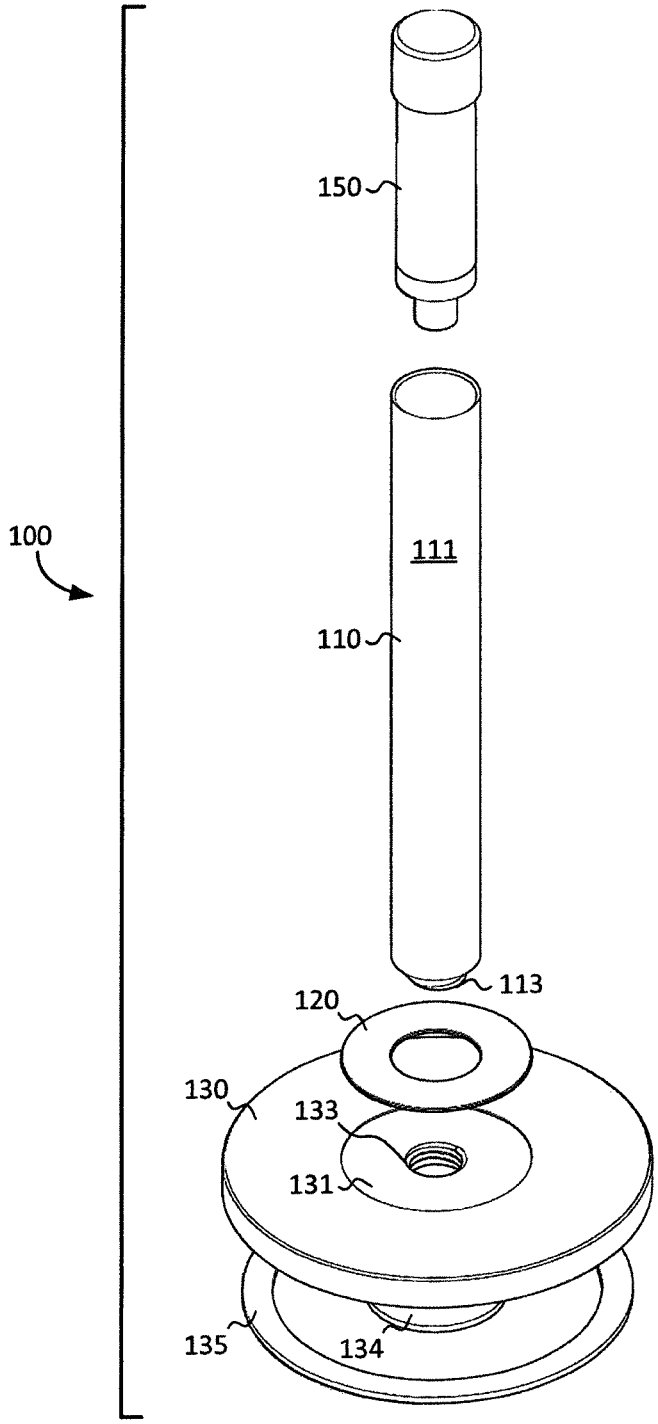
FIG. 3 is an exploded perspective view of a paper towel holder assembly, according to an exemplary embodiment of the present subject disclosure.

FIG. 3 shows an exploded perspective view of the multi-function paper towel assembly 100. The sprayer 150 is accommodated in the top open portion of the vertical shaft 110. The sprayer 150 may be located in place under the force of gravity. A bottom end of the vertical shaft 110 has a threaded extension 113 that is connected into a center mating portion of the base 130. In the drawing shown, the mating portion 133 of the base 130 is a threaded screw mechanism that accommodates the complementary threaded extension 113 on the bottom portion of the vertical shaft 110. The base 130 has a center recess 131 with a shape that accommodates the friction disc 120 positioned thereon. The bottom portion of base 130 allows for the connection of two base grips 134 and 135. Base grip 134 is circular and is positioned in the bottom center portion of the base 130. Base grip 135 is ring shaped and positioned so that it accommodates the outer circumference of the bottom portion of the base 130.

Figure 4A:
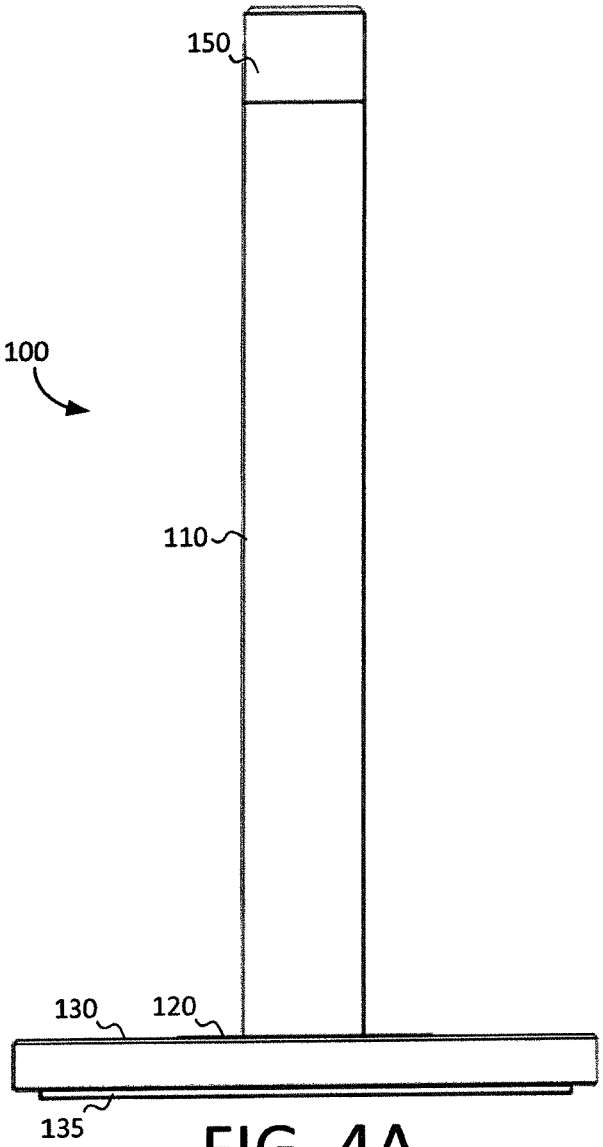
FIG. 4A is a front/side view of a paper towel holder assembly, according to an exemplary embodiment of the present subject disclosure.

FIG. 4A shows a front/side view of the assembly 100. Since the assembly 100 is symmetrical, it has the same shape from the front, back, and sides. Thus, one view is shown for sake of simplicity. As shown in FIGS. 3 and 4A, the friction ring 120 rests in center recess 131 such that its upper surface extends just above the upper surface plane of the base 130. This allows the friction disc 120 upper surface more direct contact with the paper towel which is positioned on the vertical shaft 110. The circular ring shaped base grip 135 is visible from the front view of FIG. 4A to allow for direct contact with a surface on which the assembly 100 rests. It is to be understood that the center recess 131 may be omitted and the friction element or friction ring 120 may be located on an upper surface of the base 130 to provide the resistance to the paper towel roll when is is pulled on by a user.

Figure 4B:
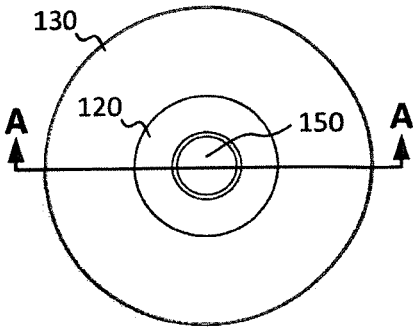
FIG. 4B is a top view of a paper towel holder assembly, according to an exemplary embodiment of the present subject disclosure.

In the upper view of the assembly 100 shown in FIG. 4B, the top portion of the sprayer 150, the friction disc 120, and the base 130 are concentric circles.

Figure 4C:
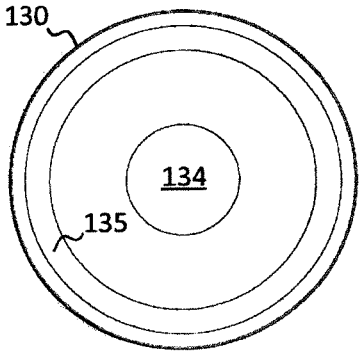
FIG. 4C is a bottom view of a paper towel holder assembly, according to an exemplary embodiment of the present subject disclosure.

In the lower view of the assembly 100 shown in FIG. 4C, the circular center base grip 134, and the circular ring outer grip 135 are shown positioned on the bottom side of base 130. The grips 134 and 135 may be composed of rubber, silicone, some other material, or combinations thereof, to provide friction between the assembly 100 and a surface on which it stands.

Figure 5:
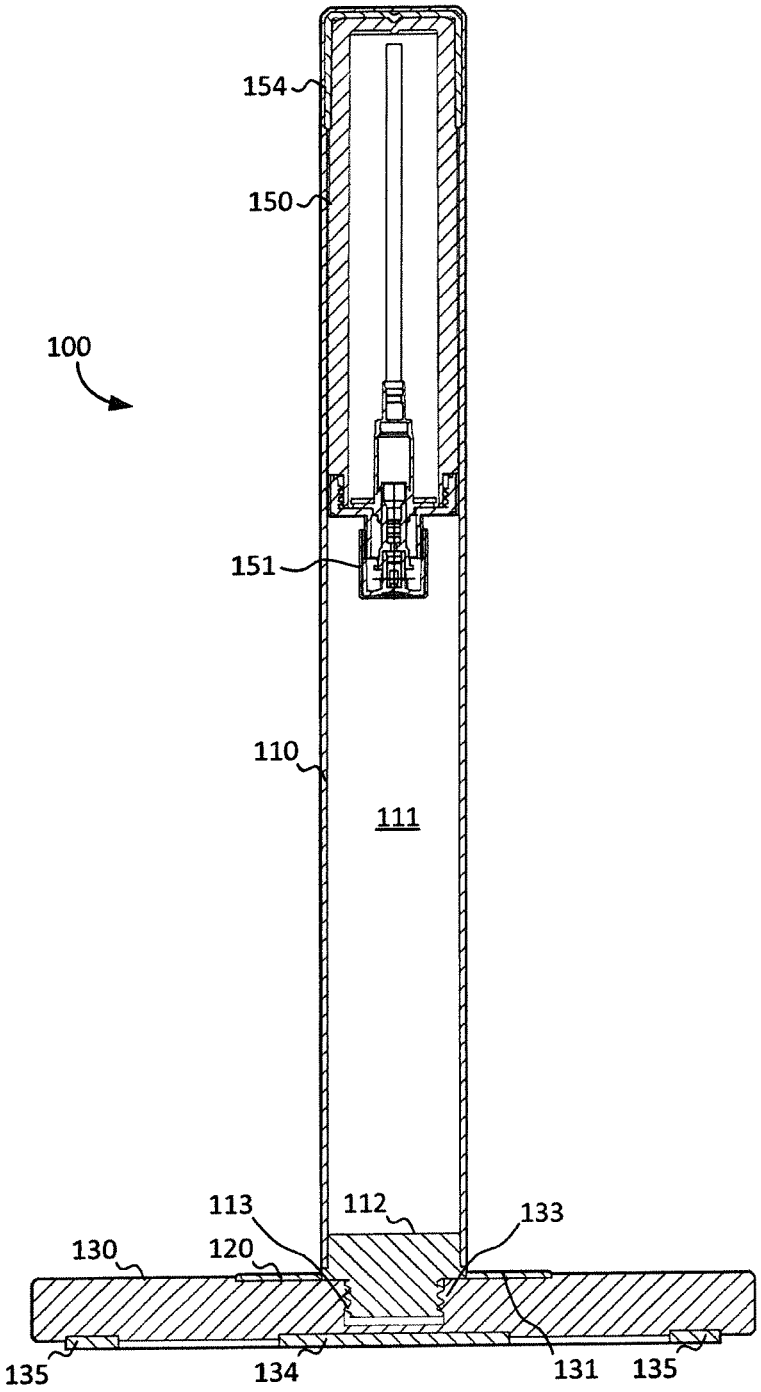
FIG. 5 is a cross-sectional view of a paper towel holder assembly along plane A-A of FIG. 4B, according to an exemplary embodiment of the present subject disclosure.

FIG. 5 shows a cross-sectional view of the paper towel holder assembly 100 along plane A-A of FIG. 4B. In this view, the sprayer 150 is shown positioned within the vertical shaft 110 under the force of gravity. The sprayer 150 is inverted within the interior 111 of the vertical shaft 110 so that the depressible button top 151 of the sprayer 150 is shown below the bottom end 154 that is visible when the sprayer 150 is positioned inside the shaft 110. At a bottom end of the vertical shaft 110 is a plug 112 having an extended threaded portion 113 that is inserted into the center aperture of base 130 and secured with the complementary thread 133. Friction disc 120 is shown encircling the bottom end of vertical shaft 110. Circular base grip 134 and ring base grip 135 extend from the bottom side of the base 130 to contact a surface that the assembly 100 is positioned thereon.

Figure 6:
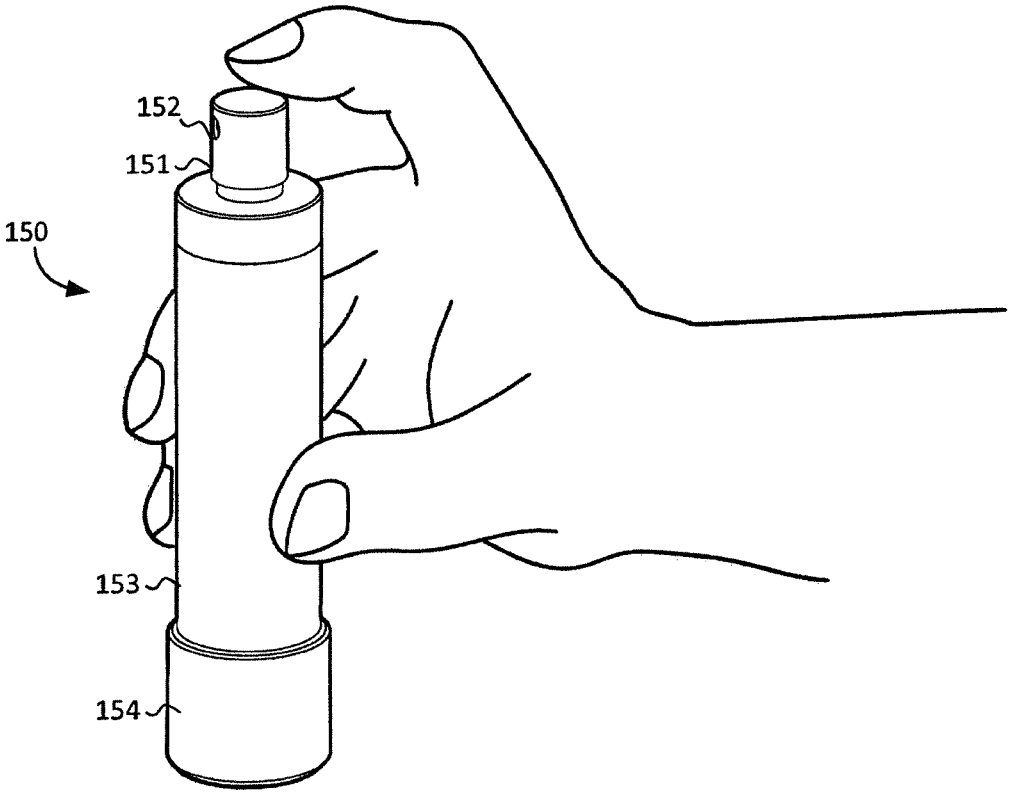
FIG. 6 is a perspective view of a removable sprayer in use, according to an exemplary embodiment of the present subject disclosure.
Figure 7:
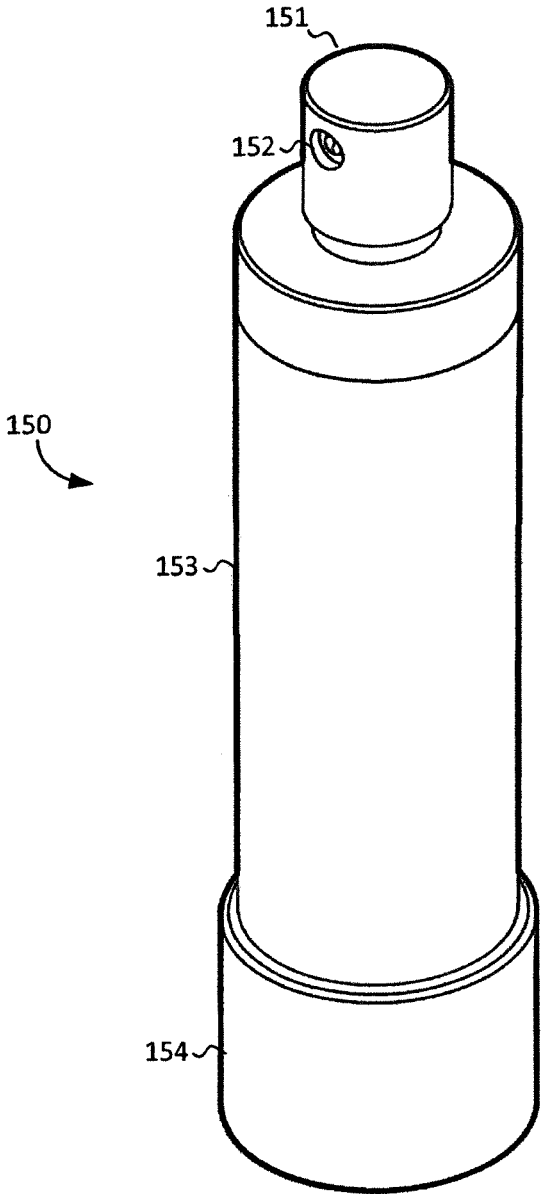
FIG. 7 is a perspective view of a removable sprayer, according to an exemplary embodiment of the present subject disclosure.

FIG. 6 shows the sprayer 150 in use, and FIG. 7 shows a close up perspective view of the sprayer 150. The sprayer 150 includes a hollow cylindrical body 153 with a depressible button top 151. When the button top 151 is depressed, fluid stored within the cylindrical body 153 is ejected out from a hole 152, which may be a spray hole or nozzle tip. The spray bottle base 154 is connected to the cylindrical body 153 through a friction fit mechanism or a threaded screw mechanism. The diameter of the sprayer base 154 is larger than the diameter of the cylindrical body 153 so that the wider base diameter allows the cylindrical body 153 to fit inside the interior 111 of the vertical shaft 110 while the sprayer base 154 has a larger diameter than the interior diameter 111 so that the sprayer base 153 cannot enter into the interior 111 of the sprayer 110.

Figure 8:
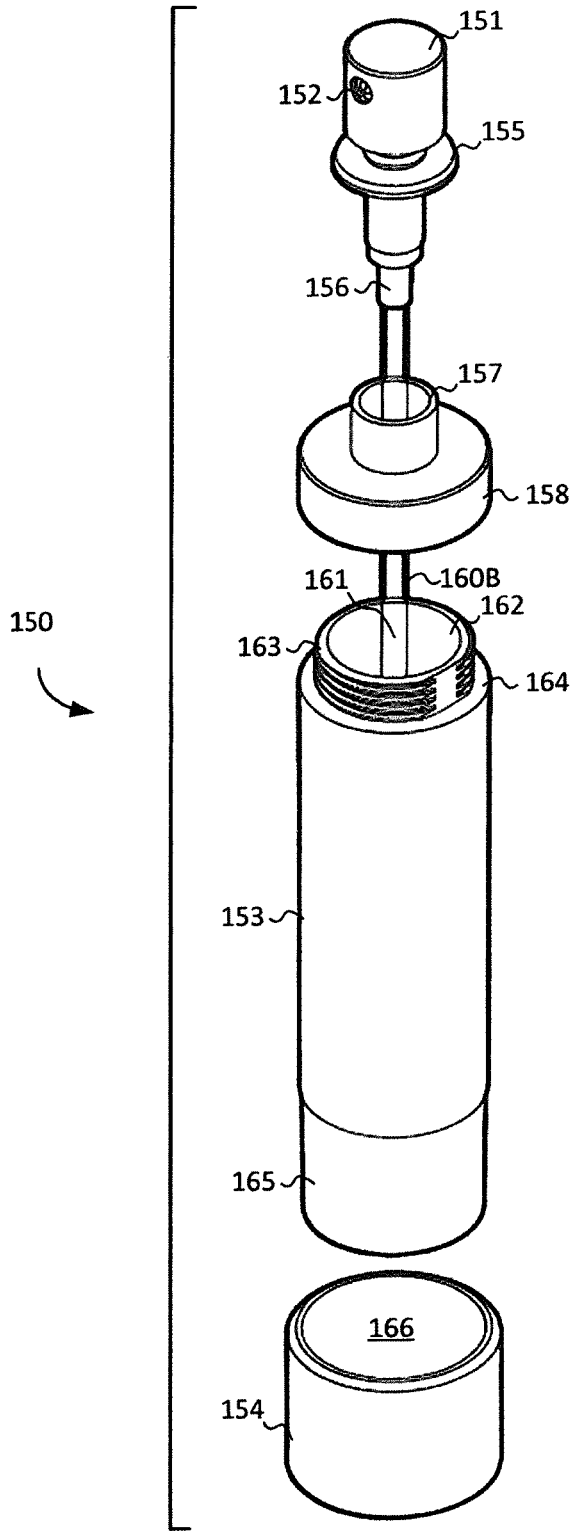
FIG. 8 is an exploded perspective view of a removable sprayer, according to an exemplary embodiment of the present subject disclosure.
Figure 10:
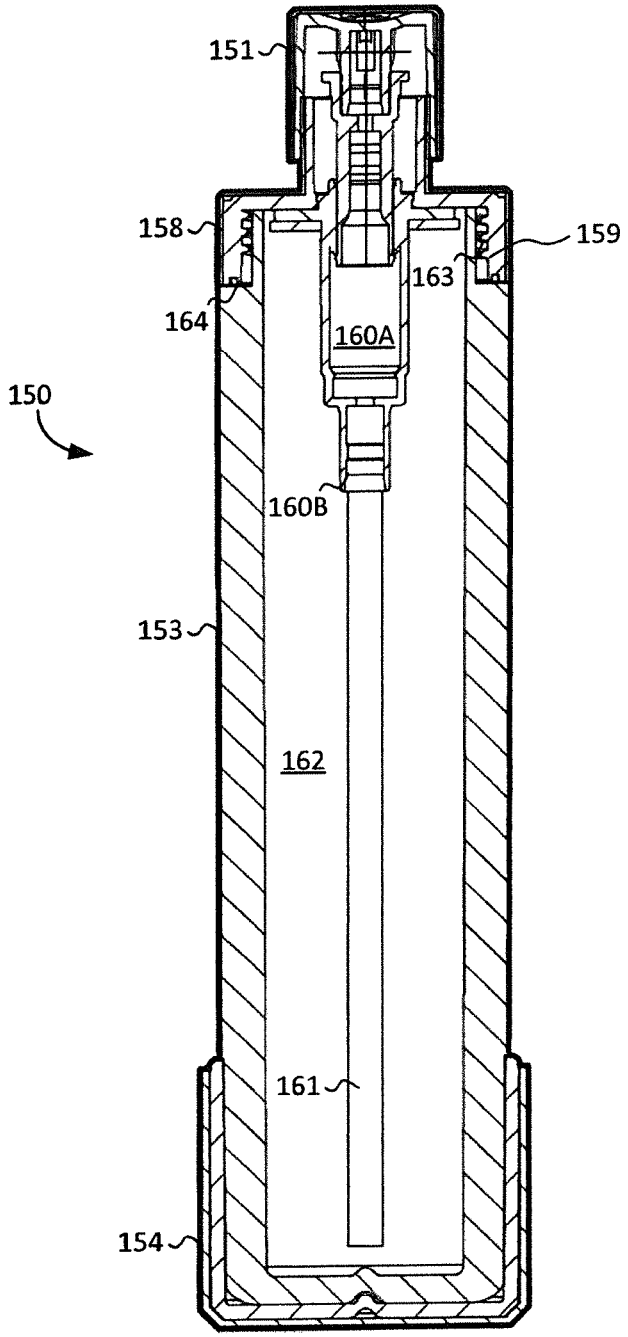
FIG. 10 is a cross-sectional view of a removable sprayer along plane B-B of FIG. 9C, according to an exemplary embodiment of the present subject disclosure.

FIG. 8 shows an exploded perspective view of the sprayer 150 according to an exemplary embodiment of the present subject disclosure. The centrally located cylindrical body 153 has a lower portion 165 which mates with a complementary portion 166 on the sprayer base 154. The connection between lower portion 165 and complementary portion 166 may be friction fit, threaded screw, or the like. Lower portion 165 may be either pushed into or screwed into complementary gap 166. On the upper side of cylindrical body 153 is a threaded screw portion 163 which mates with a complementary threaded portion 159 on the underside of cap 158. As best shown in FIGS. 8 and 10, cap 158 is screwed onto the threaded portion 163 of cylindrical body 153 until the bottom surface of cap 158 abuts the top surface 164 of cylindrical body 153.

Cap 158 serves as a base for the depressible button top 151, which slides into a top portion cylinder 157 of cap 158. The depressible button 151 is pushed into cap 158 such that its lower connector 156 slides into cylinder 157 until the top of cylinder 157 abuts a stop disc 155. A lower straw holder 160B accommodates a straw 161 that is used to pull up the fluid which is stored in the interior 162 of the cylindrical body 153.

Figure 9A:
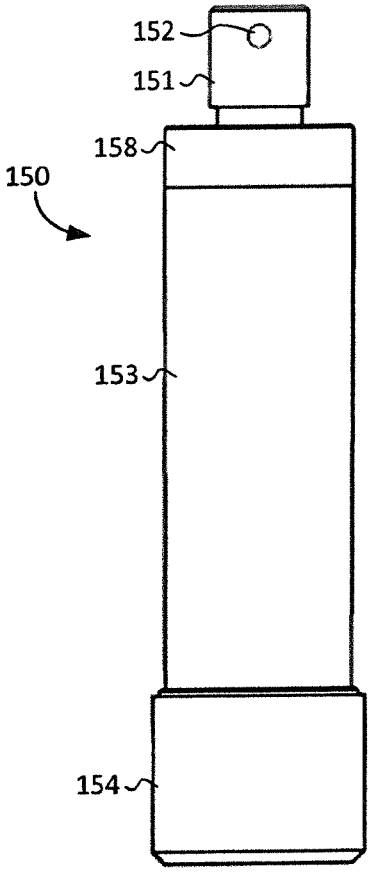
FIG. 9A is a front view of a removable sprayer, according to an exemplary embodiment of the present subject disclosure.
Figure 9B:
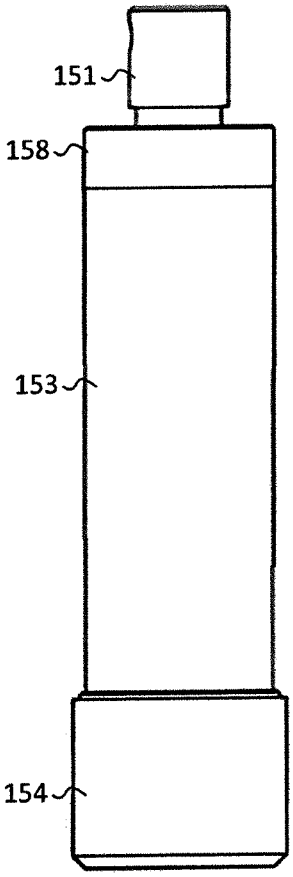
FIG. 9B is a side view of a removable sprayer, according to an exemplary embodiment of the present subject disclosure.
Figure 9C:
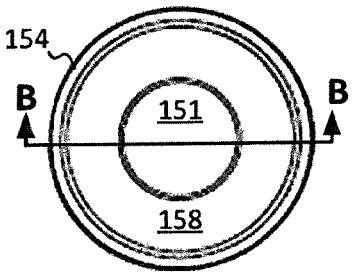
FIG. 9C is a top view of a removable sprayer, according to an exemplary embodiment of the present subject disclosure.
Figure 9D:
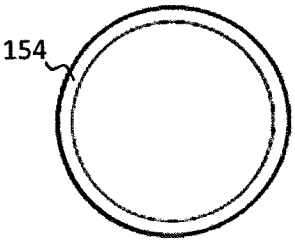
FIG. 9D is a bottom view of a removable sprayer, according to an exemplary embodiment of the present subject disclosure.

FIGS. 9A and 9B show front and side views, respectively, of a sprayer 150, according to the present subject disclosure. Further, FIGS. 9C and 9D show top and bottom views of sprayer 150. As shown in FIG. 9C, the depressible button 151, cap 158, and sprayer base 154 are shown as concentric circles from a top view perspective. FIG. 9D shows only the base 154 is visible from a bottom view perspective.

FIG. 10 shows a cross-sectional view of a sprayer 150 along plane B-B of FIG. 9C. In this view, the sprayer 150 exterior surfaces include the depressible button 151, the cap 158, the cylindrical body 153, and the sprayer base 154. Internally, a small chamber 160A is connected to a straw holder 160B, which holds straw 161 inside the interior chamber 162 of the cylindrical body 153. The connection between the cap 158 and upper portion of cylinder body 153 is shown as a threaded screw, as an example. The connection between the bottom portion of cylinder body 153 and sprayer base 154 is shown as friction fit, as an example. However, these example connections are not definitive and limiting for the sprayer 150. The connections may be any one or more types as appreciated by one having ordinary skill in the art.

Figure 11A:
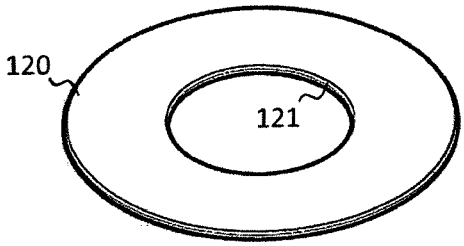
FIG. 11A is a perspective view of a friction disc, according to an exemplary embodiment of the present subject disclosure.
Figure 11B:
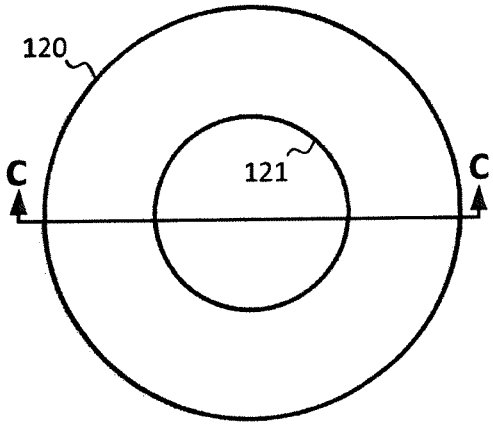
FIG. 11B is a top view of a friction disc, according to an exemplary embodiment of the present subject disclosure.
Figure 11C:
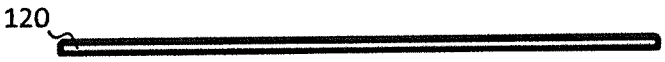
FIG. 11C is a front/side view of a friction disc, according to an exemplary embodiment of the present subject disclosure.
Figure 11D:
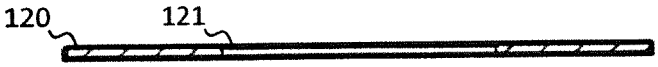
FIG. 11D is cross-sectional view of a friction disc along plane C-C of FIG. 11B, according to an exemplary embodiment of the present subject disclosure.

FIGS. 11A, 11B, and 11C show perspective, top, and front/side views, respectively, of friction disc 120, according to an exemplary embodiment of the present disclosure. FIG. 11D shows a cross-sectional view along plane C-C of FIG. 11B of frictional disc 120. In this example, the frictional disc 120 is relatively flat and circular with an inner aperture 121 that is concentric with its outer circumference. It is shaped like a large washer. As discussed above, friction disc 120 rests within a center recess 131 on the base 130, and is composed of a frictional material, such as rubber or silicone, which provides frictional resistance to an end of a paper towel that is positioned thereon to prevent or decrease the chance of excess paper towel rolling.

Figure 12:
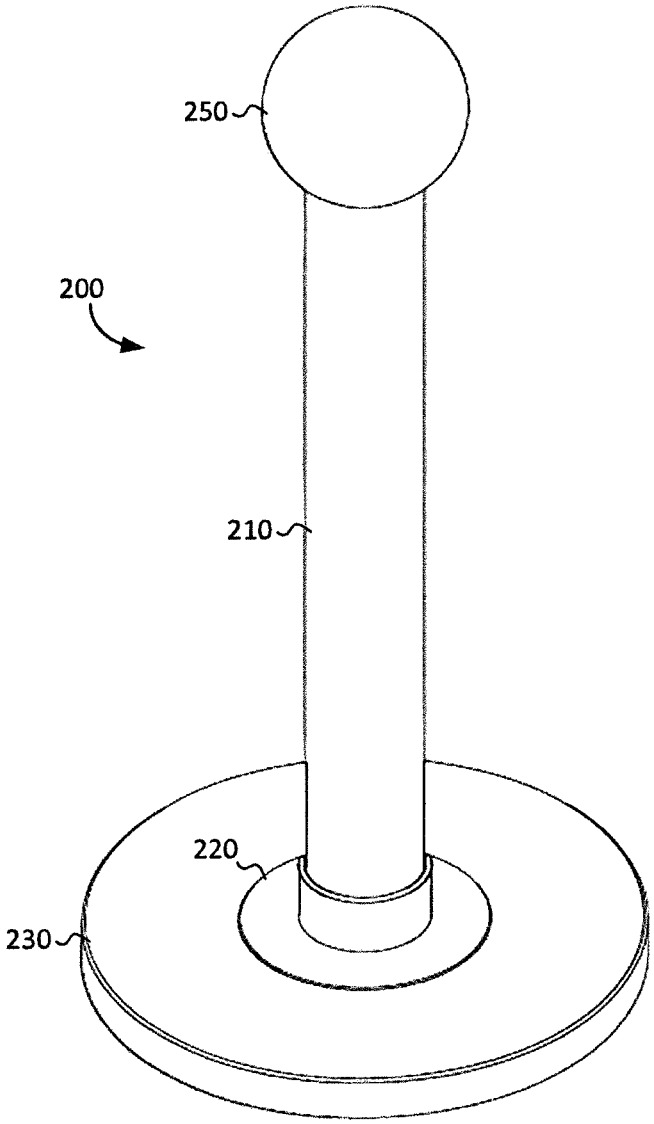
FIG. 12 is a perspective view of a paper towel holder assembly, according to another exemplary embodiment of the present subject disclosure.

FIG. 12 shows a paper towel holder assembly 200 according to another exemplary embodiment of the present subject disclosure. The assembly 200 includes a vertically oriented hollow shaft 210, which may be composed of metal, plastic, hard rubber, wood, or some combination thereof. The vertical shaft 210 is where the paper towel roll will be held by insertion through the center aperture of a standard paper towel roll.

At a bottom end of the vertical shaft 210 is a modified friction disc 220. The modified friction disc 220 is composed of, for example, rubber, silicone, or has a textual surface, or some combination thereof, for the purpose of providing a frictional contact to the paper towel that is inserted and resting thereon. When a sheet of paper towel is pulled and ripped from a roll that is positioned on the vertical shaft 210, the weight of the roll is pressed upon the modified friction disc 220 and base 230. The modified friction disc 220 has a smaller diameter than that of the base 230, and provides some level of friction to the innermost portion of a paper towel roll. Thus, if the paper towel roll is full, the modified friction disc 220 provides frictional contact and resistance to the inner portion of the paper towel roll resting therein, while an outer portion of the paper towel roll is in contact with the base. If the paper towel roll is mostly diminished so that its diameter is the same or less than the diameter of the modified friction disc 220, then the entire remaining roll of paper towel is completely in contact with the modified friction disc 220.

Figure 13:
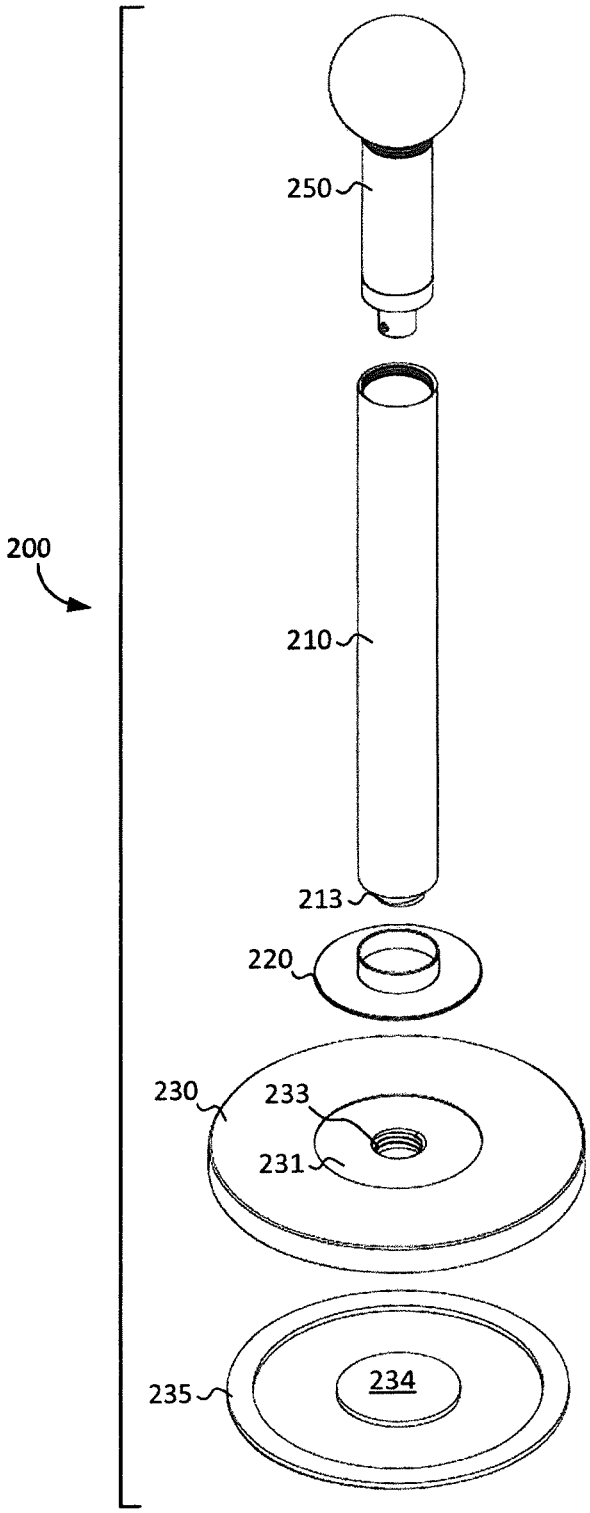
FIG. 13 is an exploded perspective view of a paper towel holder assembly, according to another exemplary embodiment of the present subject disclosure.

FIG. 13 shows an exploded view of the multi-function paper towel assembly 200. The sprayer 150 is accommodated in the top open portion of the vertical shaft 210. A bottom end of the vertical shaft 210 has a threaded extension 213 that is connected into a center mating portion of the base 230. In the drawing shown, the mating portion 233 of the base 230 is a threaded screw mechanism that accommodates the complementary threaded extension 213 on the bottom portion of the vertical shaft 210. The base 230 has a center recess 231 that has a shape that accommodates the modified friction disc 220 positioned thereon. The bottom portion of base 230 allows for the connection of two base grips 234 and 235. Base grip 234 is circular and is positioned in the bottom center portion of the base 230. Base grip 235 is ring shaped and positioned so that it accommodates the outer circumference of the bottom portion of the base 230.

Figure 14A:
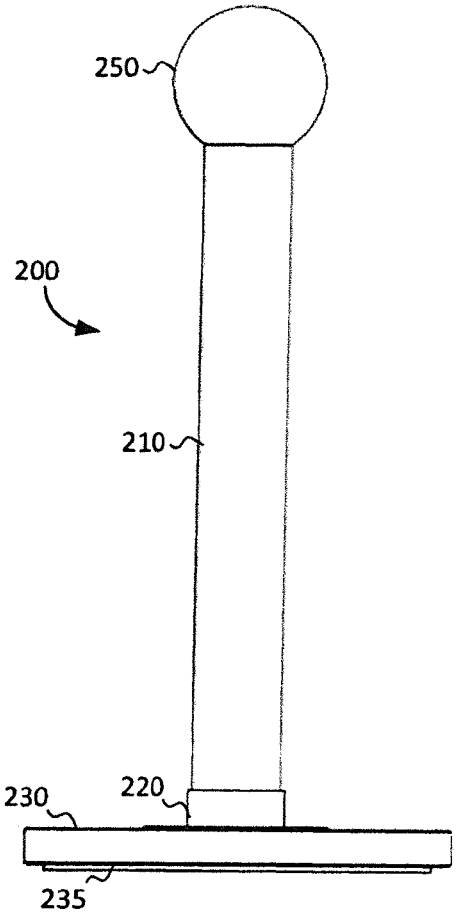
FIG. 14A is a front/side view of a paper towel holder assembly, according to another exemplary embodiment of the present subject disclosure.

FIG. 14A shows a front/side view of the assembly 200. Since the assembly 200 is symmetrical, it has the same shape from the front, back, and sides. Thus, one view is shown for sake of simplicity. As shown in FIGS. 13 and 14A, the friction ring 220 rests in center recess 231 such that its upper surface is just above the upper surface of the base 230. This allows the friction disc 220 upper surface more direct contact with the paper towel which is positioned on the vertical shaft 210. The circular ring shaped base grip 235 is visible from the front view of FIG. 14A to allow for direct contact with a surface on which the assembly 200 rests.

Figure 14B:
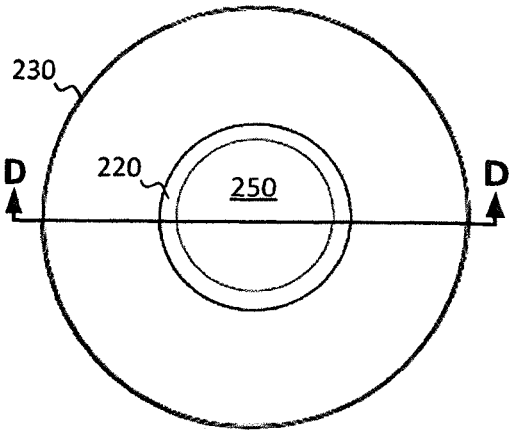
FIG. 14B is a top view of a paper towel holder assembly, according to another exemplary embodiment of the present subject disclosure.

In the top view of the assembly 200 shown in FIG. 14B, the top portion of the sprayer 250, the friction disc 220, and the base 230 are viewed as concentric circles.

Figure 14C:
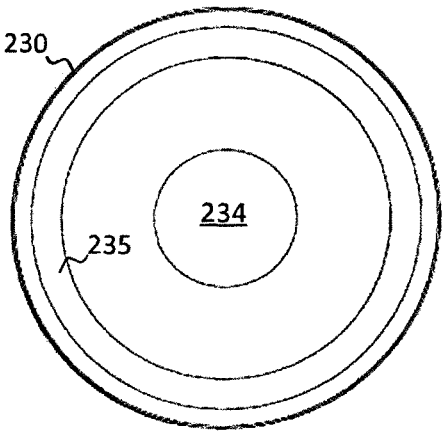
FIG. 14C is a bottom view of a paper towel holder assembly, according to another exemplary embodiment of the present subject disclosure.

In the bottom view of the assembly 200 shown in FIG. 14C, the circular center grip 234, and the circular ring outer grip 235 are shown positioned on the bottom side of base 230. The grips 234 and 235 may be composed of rubber, silicone, some other material, or combinations thereof, to provide maximized friction between the assembly 200 and a surface on which it stands.

Figure 15:
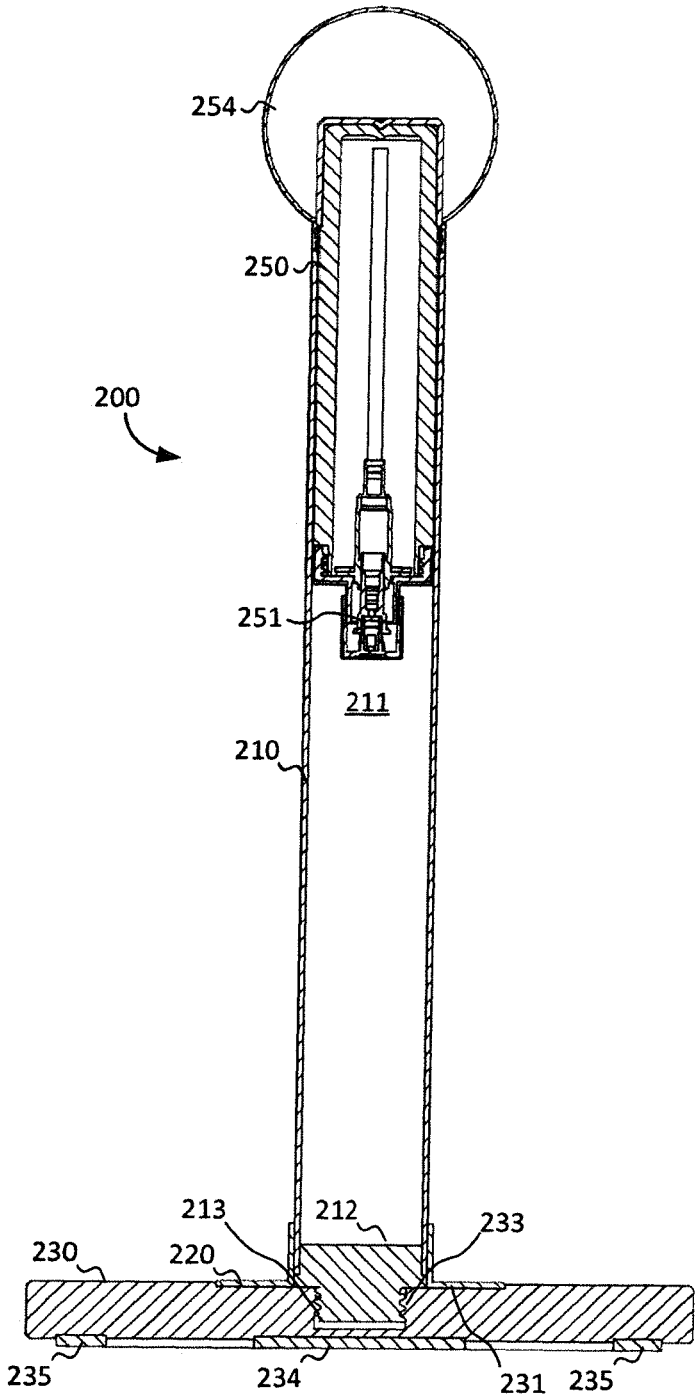
FIG. 15 is a cross-sectional view of a paper towel holder assembly along plane D-D of FIG. 14B, according to another exemplary embodiment of the present subject disclosure.

FIG. 15 shows a cross-sectional view along plane D-D of FIG. 14B. In this view, the sprayer 250 is shown positioned within the vertical shaft 210 under a force of gravity. The sprayer 250 is inverted within the interior 211 of the vertical shaft 210 so that the depressible button 251 of the sprayer 250 is shown lower than the bottom end of the sprayer base 254 that is visible when the sprayer 250 is positioned inside the shaft 210. At a bottom end of the vertical shaft 210 is a plug 212 having an extended threaded portion 213 that is inserted into the center aperture of base 230 and secured with the complementary thread 233. Friction disc 220 is shown encircling the bottom end of vertical shaft 210. Circular base grip 234 and ring base grip 235 extend from the bottom side of the base 230 to contact a surface that the assembly 200 is positioned thereon.

Figure 16A:
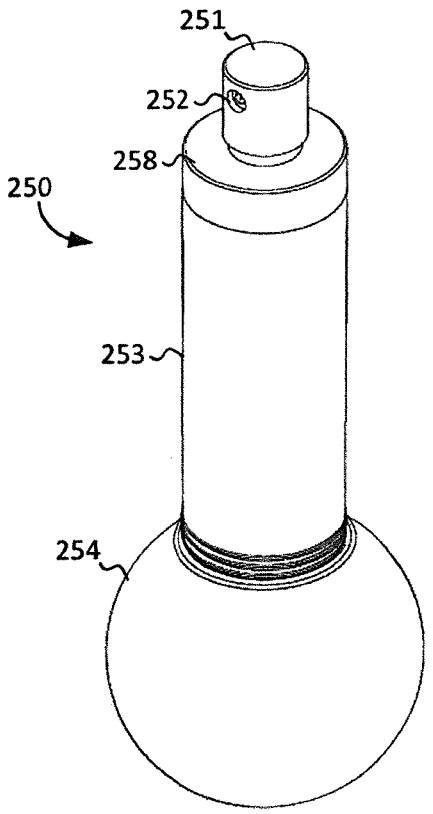
FIG. 16A is a perspective view of a removable sprayer, according to another exemplary embodiment of the present subject disclosure.

FIG. 16A shows a perspective view of the sprayer 250. The sprayer 250 includes a hollow cylindrical body 253 with a depressible button top 251. When the button top 251 is depressed, fluid stored within the cylindrical body 253 is ejected out from a hole 252, which may be a spray hole or nozzle tip. The spray base 254 is connected to the cylindrical body 253 through a friction fit mechanism or a threaded screw mechanism. The diameter of the sprayer base 254 is larger than the diameter of the cylindrical body 253 so that the wider base diameter allows the cylindrical body 253 to fit inside the interior 211 of the vertical shaft 210 while the sprayer base 254 has a larger diameter than the interior diameter 211 so that the sprayer base 254 cannot enter into the interior 211 of the sprayer 210. It should be noted that in this exemplary embodiment, the sprayer base 254 is shown as a globe or spherical or bulbous. In this configuration, with the sprayer 250 having a globe, spherical, or bulbous base 254, the paper towel can't be easily lifted up out of the vertical shaft 210 when in use. Further, a user can push down on the bulbous base 254 if needed for leverage/comfort when pulling a paper towel off.

The sprayer base 254 may also be an ornamental design. Although shown as a bulbous configuration, it is to be understood that the lower end of the sprayer base 254 may be constructed in various decorative configurations (such as a cartoon character), vehicle, animal, a star, a leaf, an abstract shape, or any other ornamental shaped item as long as its width is larger than the diameter of the sprayer body 253 and larger than the interior diameter 211 of the vertical shaft 210 so that the sprayer base 254 is maintained outside of the assembly 200 when in place (FIG. 14A).

Figure 16B:
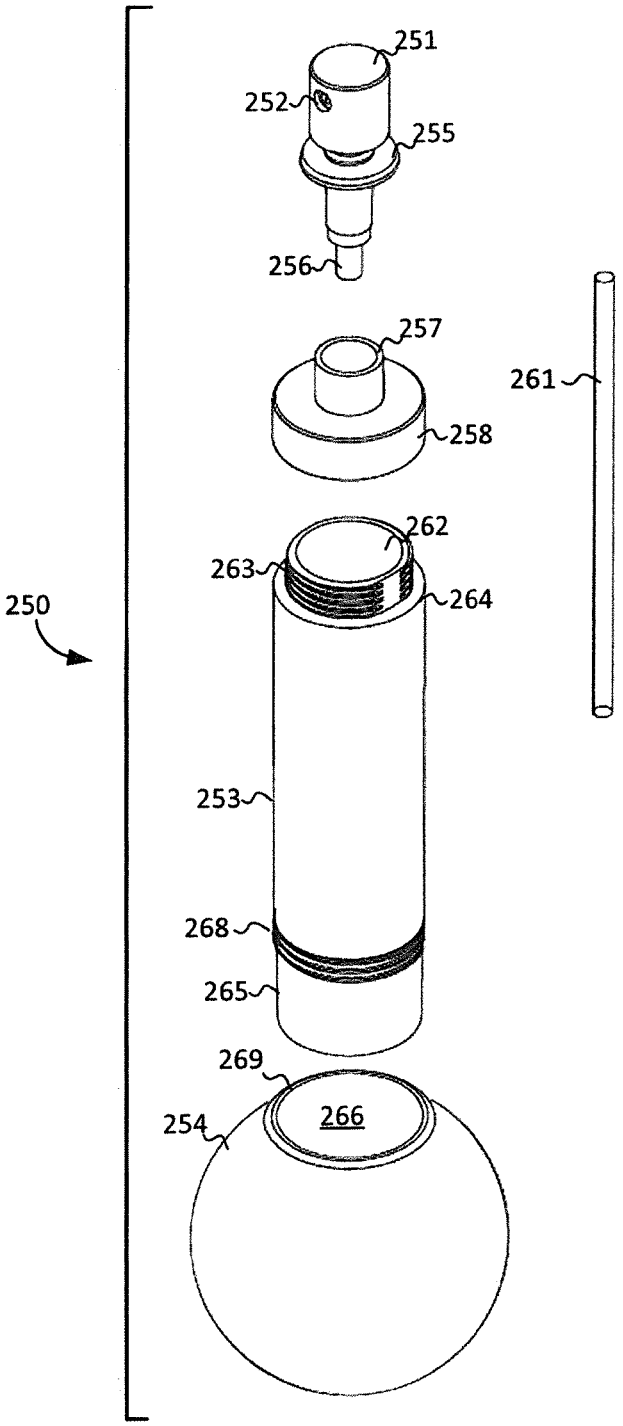
FIG. 16B is an exploded perspective view of a removable sprayer, according to another exemplary embodiment of the present subject disclosure.
Figure 18:
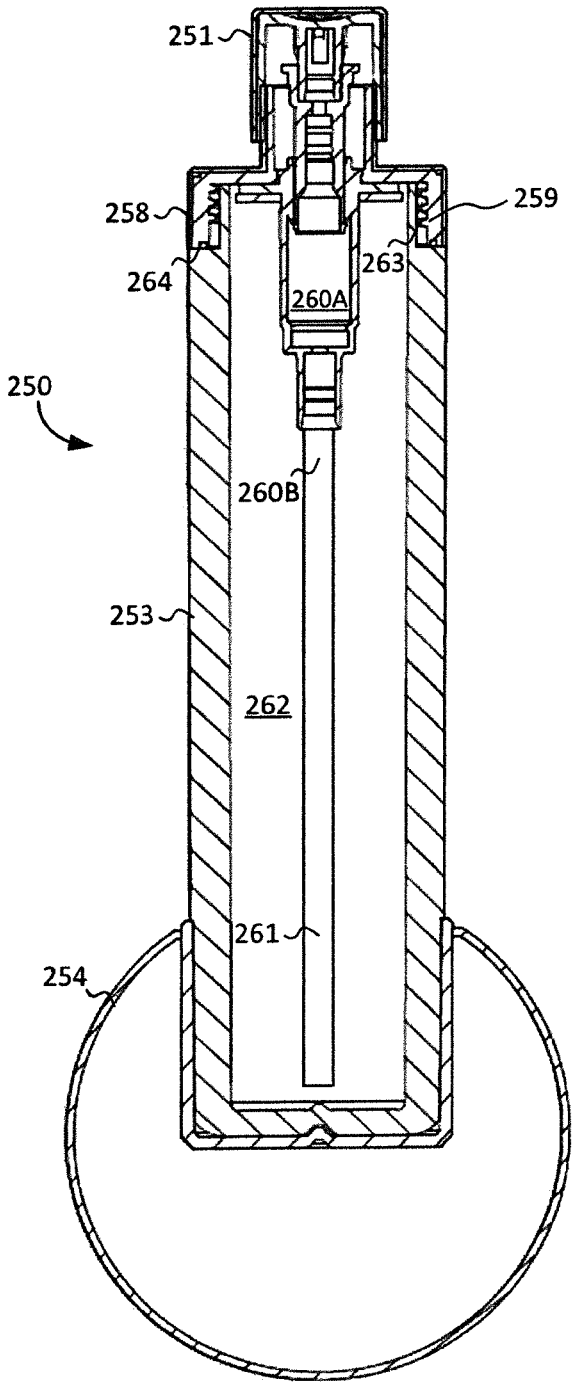
FIG. 18 is a cross-sectional view of a removable sprayer along plane E-E of FIG. 17C, according to another exemplary embodiment of the present subject disclosure.

FIG. 16B shows an exploded perspective view of the sprayer 250 according to an exemplary embodiment of the present subject disclosure. The centrally located cylindrical body 253 has a lower portion 265 which mates with a complementary portion 266 on the sprayer base 254. The connection between lower portion 265 and complementary portion 266 may be friction fit, threaded screw, or the like. Lower portion 265 may be either pushed into or screwed into complementary gap 266. In the example shown, lower portion 265 is inserted into gap 266 while thread 268 on the cylindrical body 253 engages with thread 269 in the sprayer base 254. On the upper side of cylindrical body 253 is a threaded screw portion 263 which mates with a complementary threaded portion 259 on the underside of cap 258. As best shown in FIGS. 16B and 18, cap 258 is screwed onto the threaded portion 263 of cylindrical body 253 until the bottom surface of cap 258 abuts the top surface 264 of cylindrical body 253.

Cap 258 serves as a base for the depressible button top 251, which slides into a top portion cylinder 257 of cap 258. The depressible button 251 is pushed into cap 258 such that its lower connector 256 slides into cylinder 257 until the top of cylinder 257 abuts a stop disc 255.

Figure 17A:
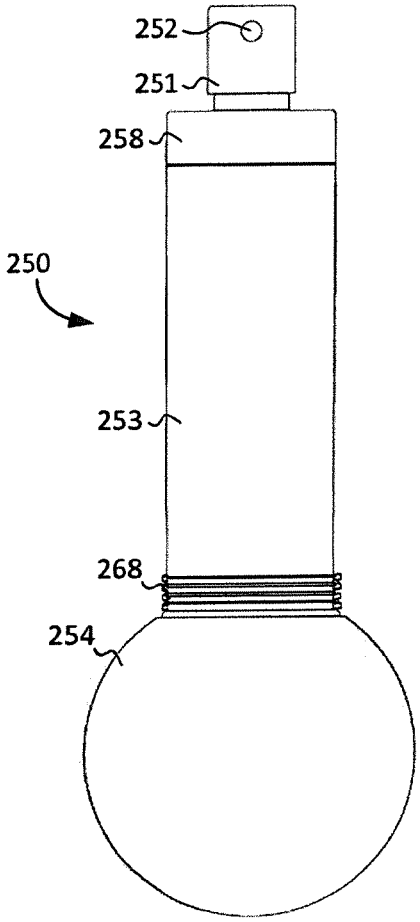
FIG. 17A is a front view of a removable sprayer, according to another exemplary embodiment of the present subject disclosure.
Figure 17B:
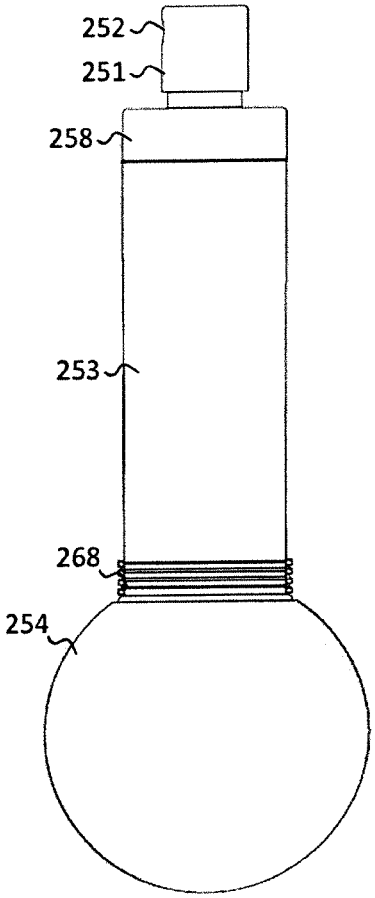
FIG. 17B is a side view of a removable sprayer, according to another exemplary embodiment of the present subject disclosure.
Figure 17C:
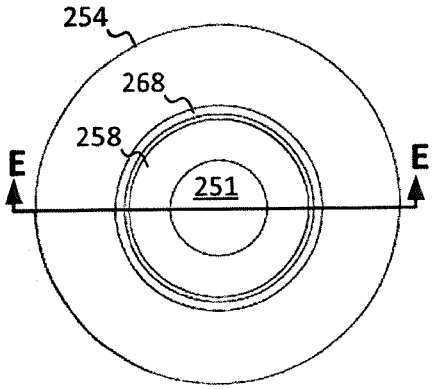
FIG. 17C is a top view of a removable sprayer, according to another exemplary embodiment of the present subject disclosure.
Figure 17D:
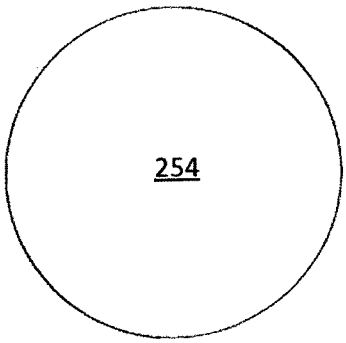
FIG. 17D is a bottom view of a removable sprayer, according to another exemplary embodiment of the present subject disclosure.

FIGS. 17A and 17B show front and side views, respectively, of a sprayer 250, according to the present subject disclosure. Further, FIGS. 17C and 17D show top and bottom views of sprayer 250. As shown from the top view perspective of in FIG. 17C, the depressible button 251, cap 258, thread 268, and sprayer base 254 are shown as concentric circles. FIG. 17D shows only the base 254 being visible from a bottom view.

FIG. 18 shows a cross-sectional view along plane E-E of FIG. 17C. In this view, the sprayer 250 exterior surfaces include the depressible button 251, the cap 258, the cylindrical body 253, and the sprayer base 254. Internally, a small chamber 260A is connected to a straw holder 260B, which holds straw 261 inside the interior chamber 262 of the cylindrical body 253. The lower straw holder 260B accommodates the straw 261 that is used to pull up the fluid which is stored in the interior 262 of the cylindrical body 253. The connection between the cap 258 and upper portion of cylinder body 253 is shown as a threaded screw, as an example. The connection between the bottom portion of cylinder body 253 and sprayer base 254 is shown as friction fit, as an example. Complementary threaded portion 268 and 269 (see FIG. 16B) are not shown for sake of simplicity. However, these example connections are not limiting for the sprayer 250. The connections may be any one or more types as appreciated by one having ordinary skill in the art.

Figure 19A:
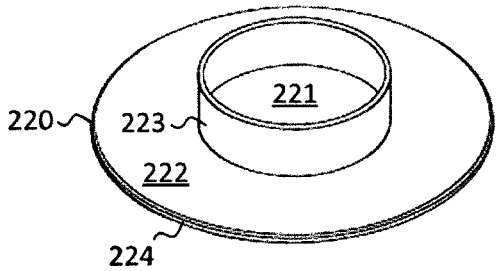
FIG. 19A is a perspective view of a modified friction disc, according to another exemplary embodiment of the present subject disclosure.
Figure 19B:
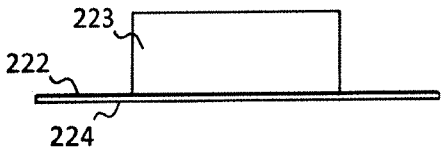
FIG. 19B is a front/side view of a friction disc, according to another exemplary embodiment of the present subject disclosure.
Figure 19C:
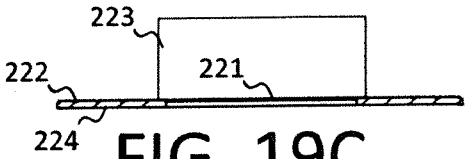
FIG. 19C is cross-sectional view of a modified friction disc along plane F-F of FIG. 19D, according to another exemplary embodiment of the present subject disclosure.
Figure 19D:
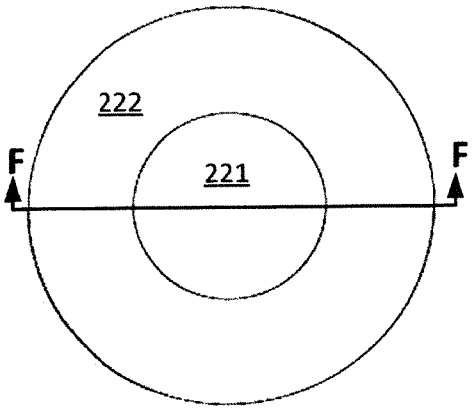
FIG. 19D is a top view of a modified friction disc, according to another exemplary embodiment of the present subject disclosure.
Figure 19E:
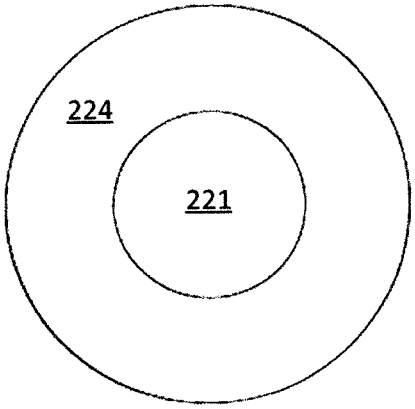
FIG. 19E is a bottom view of a modified friction disc, according to another exemplary embodiment of the present subject disclosure.

FIGS. 19A and 19B show perspective and front/side views, respectively, of friction disc 220, according to an exemplary embodiment of the present disclosure. FIGS. 19D and 19E show top and bottom views, respectively, of friction disc 220. FIG. 19C shows a cross-sectional view along plane F-F of FIG. 19D of frictional disc 220. In this example, the sprayer frictional disc 220 is relatively flat and circular with an inner aperture 221 that is concentric with its outer circumference. An outer ring having an upper surface 222 and lower surface 224 surrounds the inner aperture 221. The inner aperture 221 is further surrounded by a vertical wall or collar 223 that is perpendicular to the outer ring 222/224. The wall or collar 223 serves to surround and secure the bottom portion of the vertical shaft 210 when in position in the assembly 200. The frictional disc 220 is shaped like a modified large washer. As discussed above, the bottom surface 224 of the friction disc 220 rests within a center recess 231 on the base 230. Some portion or all of the friction disc 220 itself is composed of a friction enhancing material, such as rubber or silicone, which provides frictional resistance to an end of a paper towel that is positioned thereon to prevent or decrease the chance of excess paper towel rolling. The perpendicular wall or collar 223 in this embodiment of the frictional disc 220 provides further frictional resistance against turning of the inner tube of a roll of paper towel that is positioned on the vertical shaft 210.

Figure 20A:
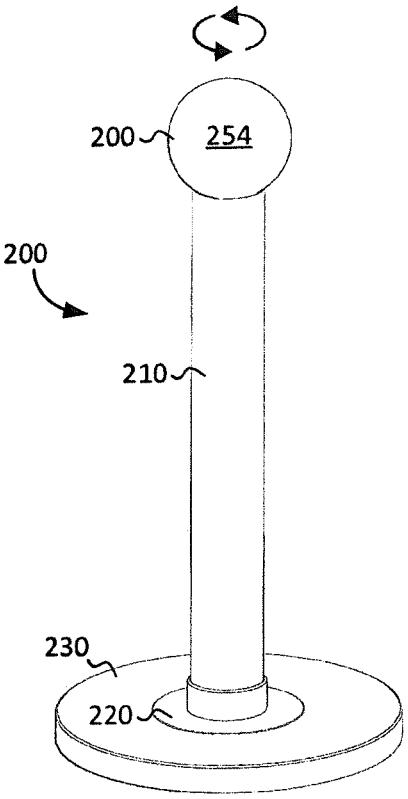
FIG. 20A is a perspective view of a paper towel holder assembly with the removable sprayer being unscrewed, according to another exemplary embodiment of the present subject disclosure.
Figure 20B:
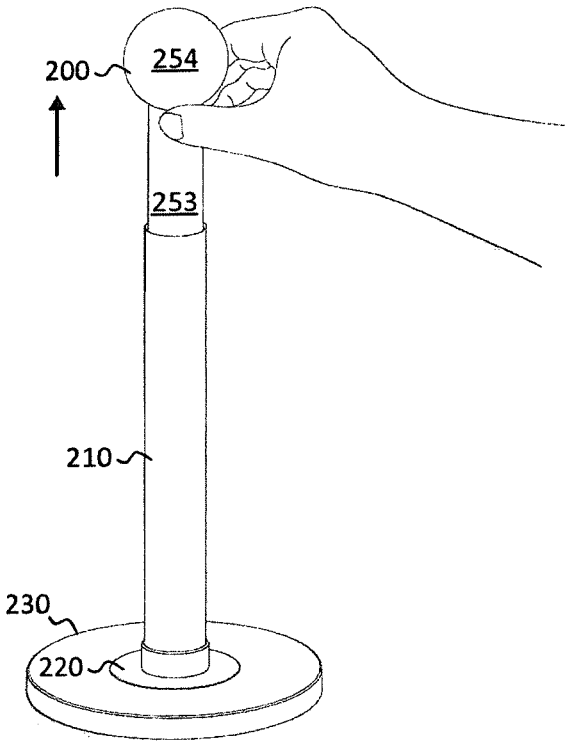
FIG. 20B is a perspective view of a paper towel holder assembly with the removable sprayer being removed, according to another exemplary embodiment of the present subject disclosure.
Figure 20C:
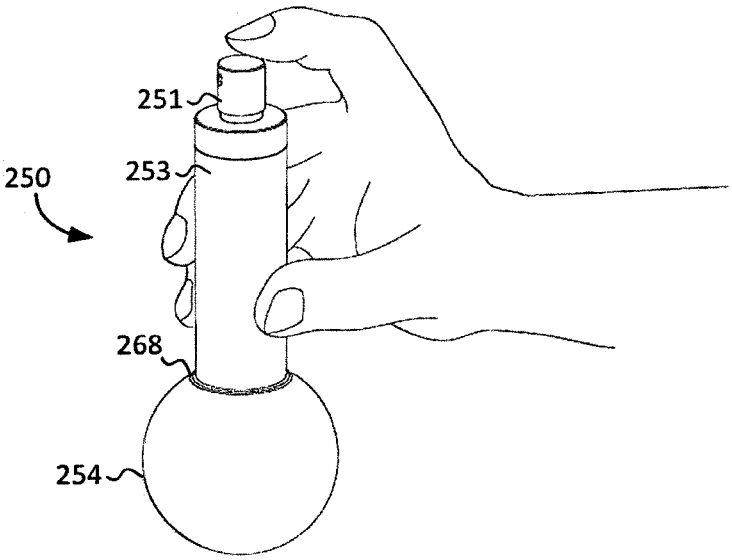
FIG. 20C is a perspective view of a removable sprayer in use, according to another exemplary embodiment of the present subject disclosure.

FIG. 20A shows assembly 200 ready for use. Sprayer may be removed from cylinder body 210 by unscrewing the base 254 from its connection to the cylindrical body 210. As shown in FIG. 20B, when the sprayer base 254 has been fully unscrewed from cylindrical body 210, the sprayer 250 is removable from the vertical shaft 210 of the assembly 200 by gripping and pulling the sprayer base 254 up and away in a direction opposite to the base 230. The vertical pull upward is in the direction of the longitudinal axis of the vertical shaft 210. FIG. 20C now shows the sprayer 250 ready for use.

Figure 21A:
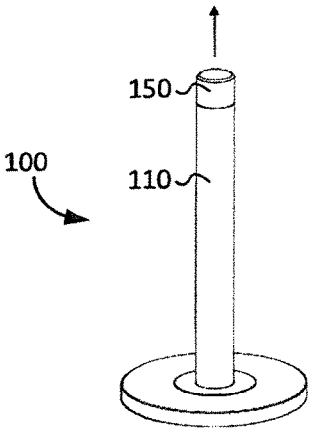
FIG. 21A is a perspective view of a paper towel holder assembly with the removable sprayer in position, according to an exemplary embodiment of the present subject disclosure.
Figure 21B:
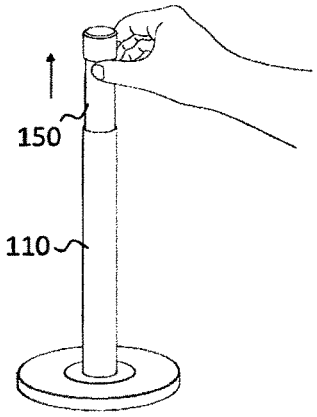
FIG. 21B is a perspective view of a paper towel holder assembly with the removable sprayer being removed, according to an exemplary embodiment of the present subject disclosure.
Figure 21C:
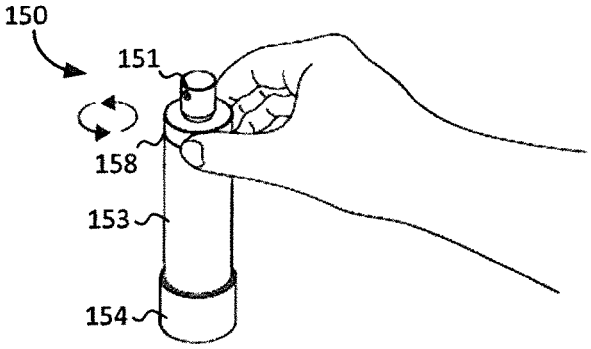
FIG. 21C is a perspective view of a removable sprayer being opened, according to an exemplary embodiment of the present subject disclosure.
Figure 21D:
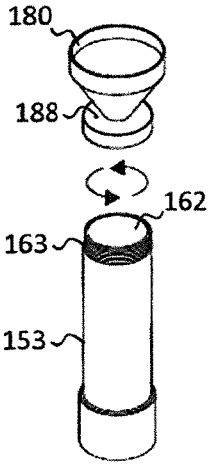
FIG. 21D is a perspective view of an opened removable sprayer being connected with a funnel, according to an exemplary embodiment of the present subject disclosure.
Figure 21E:
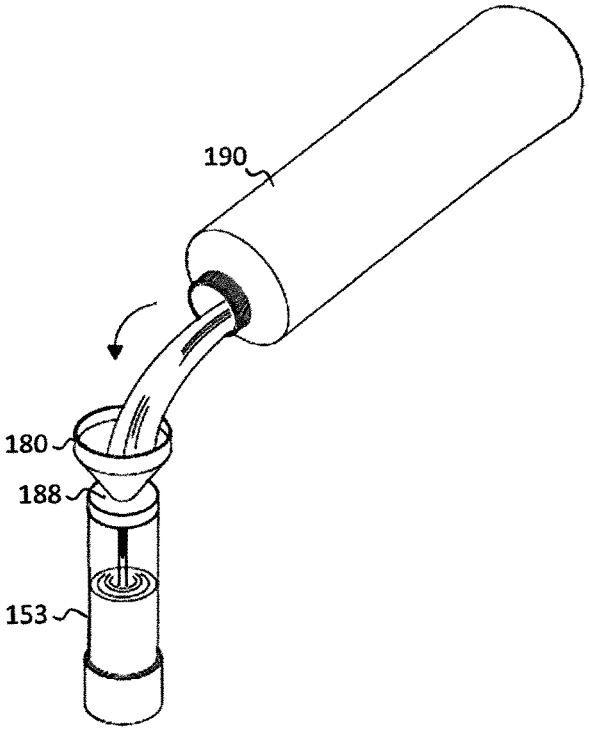
FIG. 21E is a perspective view of an opened removable sprayer being filled through a funnel, according to an exemplary embodiment of the present subject disclosure.

FIGS. 21A, 21B, 21C, 21D, and 21E show a sequence of steps to fill up a sprayer 150 in an exemplary paper towel assembly 100 by using an optional funnel 180. Although this series has been shown with exemplary assembly 100 with sprayer 150 for sake of simplicity, it can also be applicable to exemplary assembly 200 with sprayer 250. As shown in FIGS. 21A-21B, a sprayer 150 may be removed from the assembly 100 by unscrewing as needed, and then pulling upward. FIG. 21C shows the unscrewing of the cap 158 from the cylindrical body 153. Once the interior compartment or chamber 162 of the cylindrical body 153 is open and accessible, a funnel 180 may be screwed onto the threaded screw portion 163 of the open end of the cylindrical body 153. Optionally, the funnel 180 may simply be snapped in or friction fitted within the open end of the cylindrical body 153. With the funnel 180 being securely attached to the cylindrical body 153, water or other cleaning fluid may be more easily poured into the interior 162 of the cylindrical body 153 from a container 190 or faucet or other source.

Figure 22A:
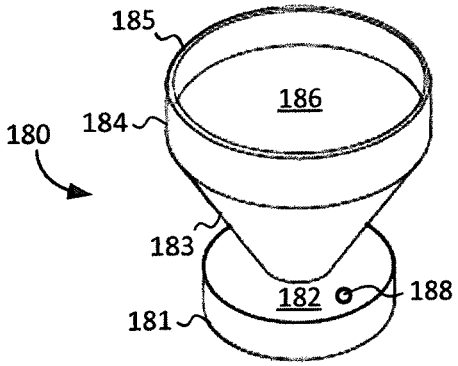
FIG. 22A is a perspective view of a funnel, according to an exemplary embodiment of the present subject disclosure.
Figure 22B:
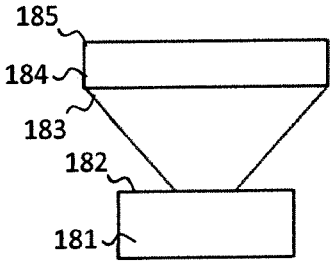
FIG. 22B is a front/side view of a funnel, according to an exemplary embodiment of the present subject disclosure.
Figure 22C:
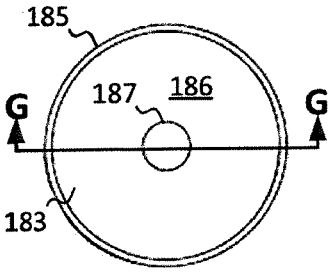
FIG. 22C is a top view of a funnel, according to an exemplary embodiment of the present subject disclosure.
Figure 22D:
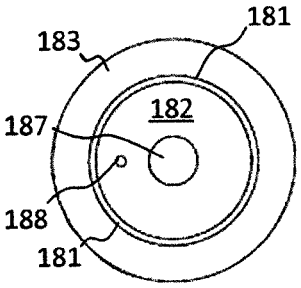
FIG. 22D is a bottom view of a funnel, according to an exemplary embodiment of the present subject disclosure.
Figure 22E:
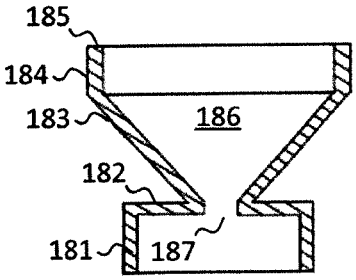
FIG. 22E is cross-sectional view of a funnel along plane G-G of FIG. 22C, according to an exemplary embodiment of the present subject disclosure.

FIGS. 22A and 22B show perspective and front/side views, respectively, of funnel 180, according to an exemplary embodiment of the present disclosure. FIGS. 22C and 22D show top and bottom views, respectively, of funnel 180. FIG. 22E shows a cross-sectional view along plane G-G of FIG. 22C of funnel 180. In this example, the funnel 180 has a round cylindrical base portion 181 that is completely open at its bottom end and is connected to a ceiling portion 182 at its top end. The ceiling portion 182 contains an open central aperture 187. Positioned above the ceiling portion 182 is a tapered conical wall 183 that connects the ceiling portion 182 to a top wall 184. The top wall 184 has a top edge 185 that defines the width of the top open end 186 of the funnel 180.

As shown from the top view of FIG. 22C, the central aperture 187 is shown surrounded by the top open end 186 and defined by the tapered conical wall 183. The outer periphery of the funnel 180 from the top view is defined by the top edge 185. As shown in FIG. 22D, the bottom view includes the central aperture 187 surrounded by the chamber created by the cylindrical base portion 181 and ceiling portion 182. Concentric to the central aperture 187 and cylindrical base portion 181 is the outer surface of the tapered conical wall 183. A small aperture 188 positioned in the ceiling portion 182 allows for air flow out of the cylindrical body 153 when fluid is poured into the opening 162, thereby preventing fluid backflow and bubbles during the filling process. The small aperture 188 or air hole allows air flow to ease the pouring, because without it, a vacuum may be created. Stated differently, because the air-tight screwed down funnel 180 onto the spray bottle 150, the fluid cleaning solution would not flow through the funnel 180 without the small aperture 188.

Figure 23:
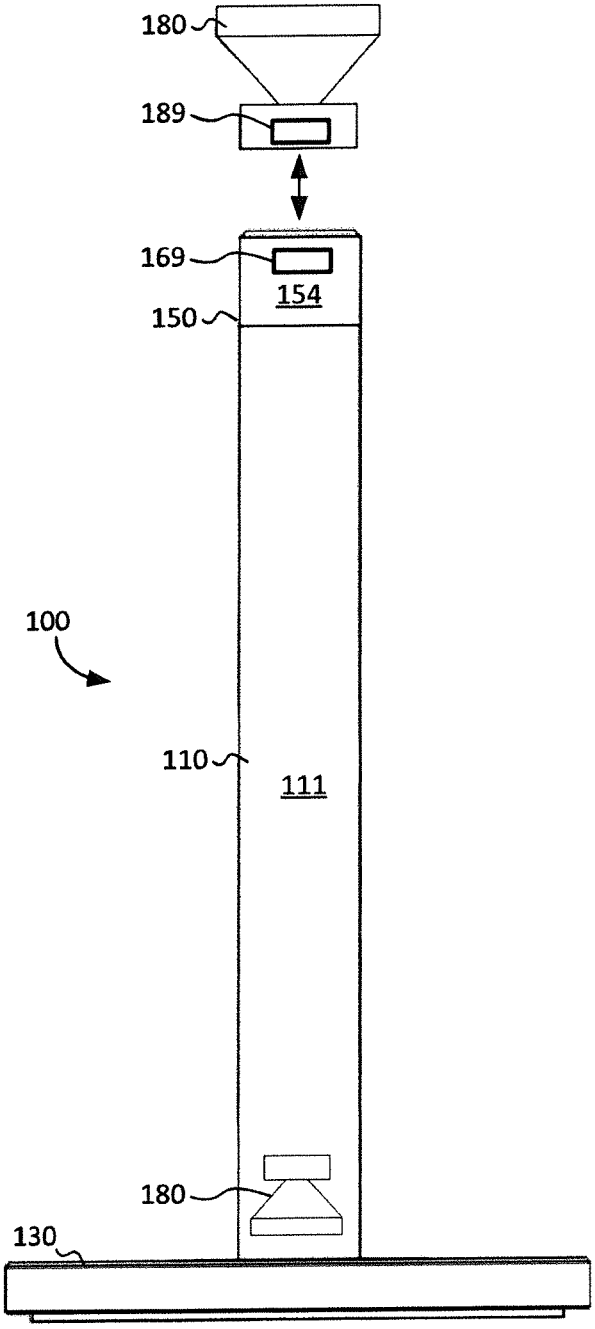
FIG. 23 is a front view of a paper towel holder assembly with funnel attached at a top portion and/or inside a vertical shaft, according to an exemplary embodiment of the present subject disclosure.

FIG. 23 shows various optional positions for the funnel 180. In one exemplary embodiment, the funnel 180 may have an internal magnet or magnetic material 189 that mates with a complementary magnet or magnetic material 169 in the sprayer base 154. When needed, the funnel 180 may be simply lifted off the sprayer bottom 154 with enough force to disconnect the magnetic attachment of magnetic materials 169 and 189. In another exemplary embodiment, the funnel 180 may be insertable into the interior portion 111 of the vertical shaft 110. When needed, the funnel 180 may be accessed by removing the sprayer 150 and then inverting the cylindrical shaft 110 to allow the funnel 180 to drop out. Other variations are also possible and within the scope of the present subject disclosure. It is also to be understood that the funnel 180 may be constructed of a flexible material so that tit may be bent or contorted into various suitable storage positions within the assembly 100.

The illustrations and examples provided herein are for explanatory purposes and are not intended to limit the scope of the appended claims. It will be recognized by those skilled in the art that changes, or modifications may be made to the above-described embodiments without departing from the broad inventive concepts of the invention. It is understood therefore that the invention is not limited to the particular embodiments which are described but is intended to cover all modifications and changes within the scope and spirit of the invention.

The foregoing disclosure of the exemplary embodiments of the present subject disclosure has been presented for purposes of illustration and description. It is not intended to be exhaustive or to limit the subject disclosure to the precise forms disclosed. Many variations and modifications of the embodiments described herein will be apparent to one of ordinary skill in the art in light of the above disclosure. The scope of the subject disclosure is to be defined only by the claims appended hereto, and by their equivalents.

Further, in describing representative embodiments of the present subject disclosure, the specification may have presented the method and/or process of the present subject disclosure as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present subject disclosure should not be limited to the performance of their steps in the order written, and one skilled in the art can readily appreciate that the sequences may be varied and still remain within the spirit and scope of the present subject disclosure.

What is claimed:

1. A paper towel holder assembly, comprising:
a base having a top surface and a lower surface;
a hollow vertical shaft connected at a bottom end to an aperture in the base; and
a removable spray container having a spray hole and a base, and positioned at a top end of the vertical shaft, wherein the spray container is inverted such that its base is accessible and positioned outside of the vertical shaft and its spray hole is positioned inside of the hollow vertical shaft.

2. The paper towel holder assembly of claim 1, wherein the base has a recess portion on the top surface into which a friction element fits therein.

3. The paper towel holder assembly of claim 2, wherein the friction element is a circular disc and is composed of rubber or silicone.

4. The paper towel holder assembly of claim 3, wherein the friction element has a collar positioned perpendicularly from a plane of the circular disc.

5. The paper towel holder assembly of claim 1, the spray container having an outer diameter slightly smaller than an inner diameter of the vertical shaft.

6. The paper towel holder assembly of claim 1, the spray container base having a diameter that is larger than a diameter of the vertical shaft.

7. The paper towel holder assembly of claim 1, wherein the spray container is attached to the vertical shaft through a threaded connection.

8. The paper towel holder assembly of claim 1, wherein the spray container is connected to the vertical shaft through at least one of: a friction fit connection; a threaded connection or a weight of gravity.

9. The paper towel holder assembly of claim 1, wherein the spray container has a cap which is removable from a body portion to access an interior of the body portion.

10. The paper towel holder assembly of claim 9, further comprising a funnel which is adapted to fill a fluid into the body portion when the cap is removed.

11. The paper towel holder assembly of claim 10, wherein the funnel is connectably stored with the paper towel holder assembly.

12. The paper towel holder assembly of claim 1, wherein the spray container base is configured as a decorative element.

13. A paper towel holder assembly, comprising:
a base;
a friction element disposed on a top surface of the base;
a hollow vertical shaft connected at a bottom end to an aperture in the base; and a removable spray container having a spray hole and a base, and positioned at a top end of the vertical shaft, wherein the spray container is inverted such that its base is positioned outside of the vertical shaft and its spray hole is positioned inside of the hollow vertical shaft.

14. The paper towel holder assembly of claim 13, wherein the spray container has a cap which is removable from a body portion to access an interior compartment of the body portion.

15. The paper towel holder assembly of claim 13, the spray container base having a diameter that is larger than a diameter of the vertical shaft.

16. The paper towel holder assembly of claim 14, further comprising a funnel which is adapted to fill a fluid into the body portion when the cap is removed, and is connectably stored with the paper towel assembly.

17. A paper towel holder assembly, comprising:

a base having a top surface and a bottom surface;

a friction element disposed on the top surface of the base;

a hollow vertical shaft connected at a bottom end through the friction element to an aperture in the base; and a removable spray container having a cap which is removable from a body portion to access an interior of the body portion, a spray hole and a base, and positioned at a top end of the vertical shaft, wherein the spray container is inverted such that its base is positioned outside of the vertical shaft and its spray hole is positioned inside of the hollow vertical shaft.

18. The paper towel holder assembly of claim 17, wherein the friction element is disposed in a recess located on the top surface of the base, and wherein a second friction element is provided on the bottom surface of the base.

19. The paper towel holder assembly of claim 17, the removable spray container base having a diameter that is larger than a diameter of the vertical shaft.

20. The paper towel holder assembly of claim 17, further comprising a funnel which is adapted to fill a fluid into the body portion when the cap is removed, and is connectably stored with the paper towel assembly.

* * * * *